US007152891B2

(12) United States Patent
Bergen et al.

(10) Patent No.: US 7,152,891 B2
(45) Date of Patent: Dec. 26, 2006

(54) FIELD-REVERSIBLE LOCKING MECHANISM

(75) Inventors: Gary Bergen, Yorba Linda, CA (US); Gerard Adelmeyer, Monarch Beach, CA (US)

(73) Assignee: Newfrey LLC, Newark, DE (US)

( * ) Notice: Subject to any disclaimer, the term of this patent is extended or adjusted under 35 U.S.C. 154(b) by 174 days.

(21) Appl. No.: 10/937,603

(22) Filed: Sep. 9, 2004

(65) Prior Publication Data

US 2006/0049644 A1 Mar. 9, 2006

(51) Int. Cl.
*E05B 15/00* (2006.01)

(52) U.S. Cl. ..... 292/244; 292/245

(58) Field of Classification Search ..... 292/244, 292/245 X, 336.3, DIG. 53; 70/461, 462
See application file for complete search history.

(56) References Cited

U.S. PATENT DOCUMENTS 2,676,827 A * 4/1954 Schlage ..... 292/244
3,235,301 A * 2/1966 Russell et al. ..... 292/244
4,435,967 A 3/1984 Best et al.
4,655,059 A 4/1987 Best et al.
4,696,174 A * 9/1987 Marks ..... 70/451
4,876,783 A 10/1989 Campion et al.
5,036,575 A 8/1991 Campion et al.
5,123,683 A * 6/1992 Solovieff ..... 292/172
5,125,696 A * 6/1992 Robida et al. ..... 292/169.16
5,141,269 A * 8/1992 Haq et al. ..... 292/169
5,177,987 A * 1/1993 Shen ..... 70/224
5,265,924 A * 11/1993 Kim ..... 292/336.3
5,441,318 A * 8/1995 Ghostley ..... 292/336.3
5,481,890 A * 1/1996 Millman ..... 70/224
5,564,296 A * 10/1996 Theriault et al. ..... 70/224
5,657,653 A 8/1997 Hensley et al.
5,727,406 A * 3/1998 Banducci ..... 70/224
5,752,399 A * 5/1998 Shen ..... 70/224
5,813,255 A 9/1998 Tell, III et al.
5,816,086 A * 10/1998 Russell, IV ..... 70/422
5,873,274 A * 2/1999 Sauerland ..... 70/208
6,038,986 A * 3/2000 Ransil et al. ..... 108/145
6,141,998 A * 11/2000 Seo ..... 70/224
6,302,457 B1 * 10/2001 Shen ..... 292/357
6,568,725 B1 * 5/2003 Furlong et al. ..... 292/336.5
6,584,816 B1 * 7/2003 Lee ..... 70/224
6,681,605 B1 * 1/2004 Huang ..... 70/224
6,802,546 B1 * 10/2004 Bates et al. ..... 292/358
6,886,379 B1 * 5/2005 Simon et al. ..... 70/215
6,916,053 B1 * 7/2005 Lin ..... 292/336.3

* cited by examiner

*Primary Examiner*—Gary Estremsky
*Assistant Examiner*—Mark Williams
(74) *Attorney, Agent, or Firm*—Richard J. Veltman; John D. DelPonti

(57) ABSTRACT

A lockset for use in a door assembly is provided and includes an interior mechanism having a first escutcheon, a first housing, and a first retainer shield and an exterior mechanism having a second escutcheon, a second housing, and a second retainer shield. In addition, a spindle assembly is provided to interface with a latch mounted on the door assembly and allow for selective locking of the lockset. The spindle assembly is lockable in one of two rotational positions relative the first and second escutcheons when the first housing engages the first retainer shield and the second housing engages the second retainer shield. By providing rotational adjustment of the spindle assembly relative the first and second escutcheons, the lockset is able accommodate either a left or a right-handed door.

7 Claims, 6 Drawing Sheets

FIELD-REVERSIBLE LOCKING MECHANISM

FIELD OF THE INVENTION

The present invention relates to locking mechanisms, and more particularly, to a locking mechanism which may be readily configured for either a left-handed or right-handed door installation.

BACKGROUND OF THE INVENTION

Lever or knob locksets commonly require a specific orientation with a latch of a door assembly to ensure that the lockset properly seats within the latch when the door assembly is in a closed or locked position. Because the orientation of the latch is determined by the handing of the door, such locksets typically become "handed" as well, thereby limiting the application of the lockset. Specifically, handed locksets constrain the styling options of the escutcheons, knobs, and levers by requiring separate components to accommodate handed doors. In addition, handed locksets suffer from the disadvantage of requiring storing, manufacturing, and design of components for both hands, thereby increasing manufacturing and production costs.

During installation operations, it is desirable that a lockset be capable of accommodating either a right-handed or a left-handed door. Further, it is desirable that a lockset accommodate varying exterior and interior door designs. Further yet, it is desirable that a lockset be capable of utilizing common components across various designs in an effort to reduce product variation and increase manufacturing efficiency. To that end, a lockset having a reversible locking mechanism plays a significant role.

Some conventional locksets attempt to eliminate the problem of handed doors by providing the installer with an adjustment mechanism to toggle the lockset between a right-handed and left-handed setup. In this manner, the adjustable lockset obviates the need to have multiple handed locksets by providing the installer with the ability to fit a single lockset to either a right-handed or a left-handed door. However, such locksets, while adequately providing for attachment and use on either a right-handed or a left-handed door, suffer from the disadvantage that conversion between the two hands often requires extensive disassembly and is typically a time consuming process.

Therefore, a lockset that provides for installation on either a right-handed or a left-handed door, without requiring extensive disassembly of the lockset, is desirable in the industry. Furthermore, a lockset that is easily movable between a right-handed and a left-handed configuration while concurrently enabling a plurality of escutcheon, knob, and lever designs is also desirable.

SUMMARY OF THE INVENTION

Accordingly, the present invention provides a lockset for use in a door assembly, whereby the lockset includes an interior mechanism having a first escutcheon, a first housing, and a first retainer shield and an exterior mechanism having a second escutcheon, a second housing, and a second retainer shield. In addition, a spindle assembly is provided to interface with a latch bolt mounted on the door assembly to allow for selective locking of the lockset. The spindle assembly is lockable in one of two rotational positions relative the first and second escutcheons when the first housing engages the first retainer shield and the second housing engages the second retainer shield. By providing rotational adjustment of the spindle assembly relative the first and second escutcheons, the lockset is able to accommodate either a left or a right-handed door, thereby providing the lockset with increased flexibility.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
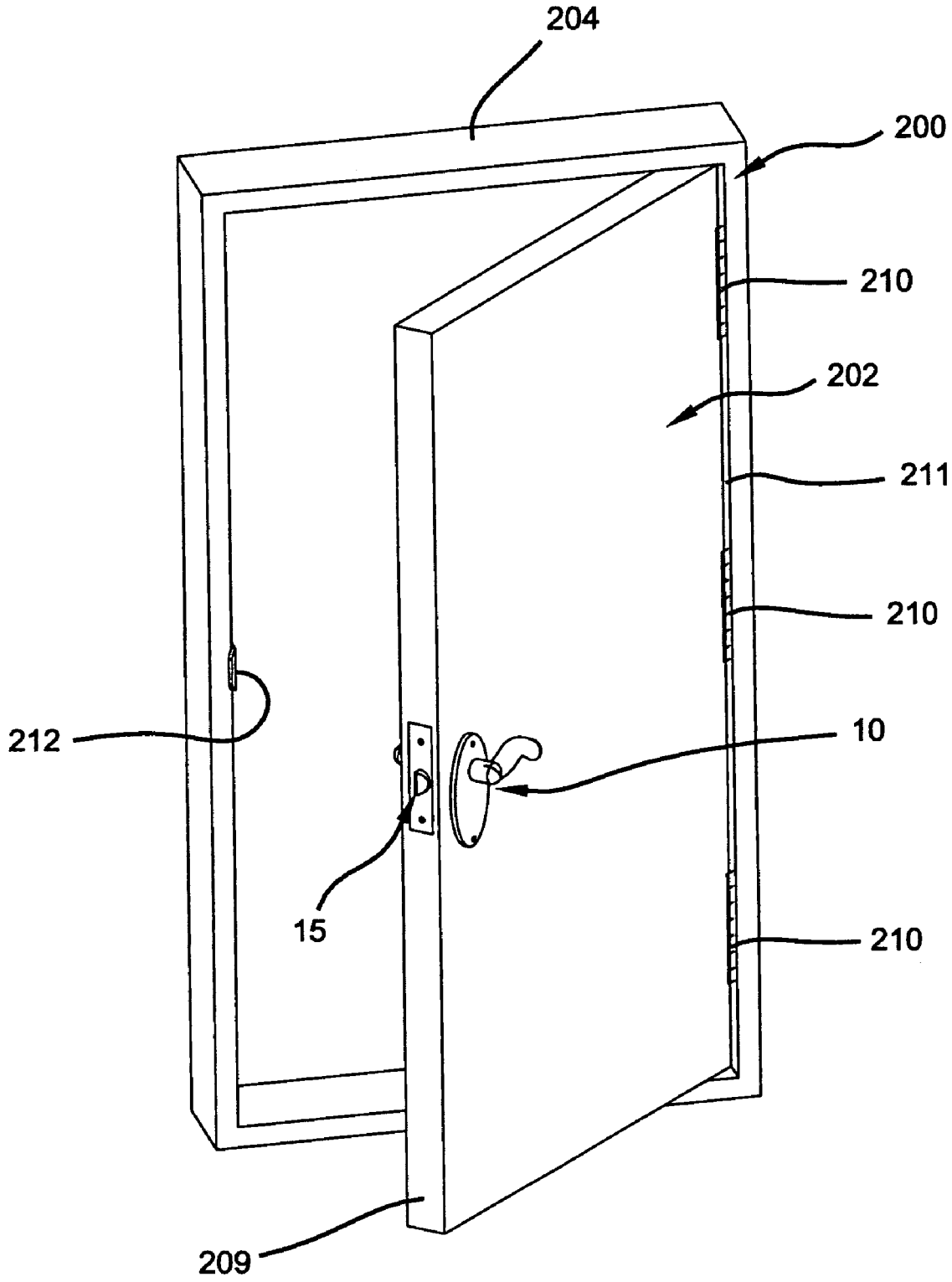
FIG. 1 is a perspective view of a lockset in accordance with the principals of the present invention mounted on a door assembly.

The following description of the preferred embodiment is merely exemplary in nature and is in no way intended to limit the invention, its application, or uses.

With reference to the figures, a lockset 10 is provided and includes an interior mechanism 12, an exterior mechanism 14, a latch bolt mechanism 15, and a spindle assembly 16. The spindle assembly 16 is operable to toggle the latch bolt assembly 15 between a locked and an unlocked position, whereby the exterior and interior mechanisms 12, 14 are operable to lock the spindle assembly 16 in one of two positions relative to the interior and exterior mechanisms 12, 14 to enable the lockset 10 to be installed on either a right-handed or a left-handed door.

As can be appreciated, the spindle assembly 16 and latch bolt mechanism 15 must be properly positioned on a door assembly to function as designed. The latch bolt mechanism 15 must be disposed on an edge of a door to engage a doorframe and retain the door in a closed position. In this regard, the latch bolt mechanism 15 will be positioned on opposite edges of a right-handed and a left-handed door as each door engages a doorframe on an opposite side. To accommodate both a right-handed and a left-handed door, the exterior and interior mechanisms 12, 14 are operable to rotate the spindle assembly 16 to thereby properly align the spindle assembly 16 relative to the latch bolt mechanism 15. Specifically, the present invention provides an added degree of adjustment to allow the spindle assembly 16 which is asymmetric to be properly oriented to accommodate both right-handed and left-handed doors. In this manner, the lockset 10 may accommodate both a left-handed and a right-handed door using the same latch bolt mechanism 15 and spindle assembly 16.

Figure 2:
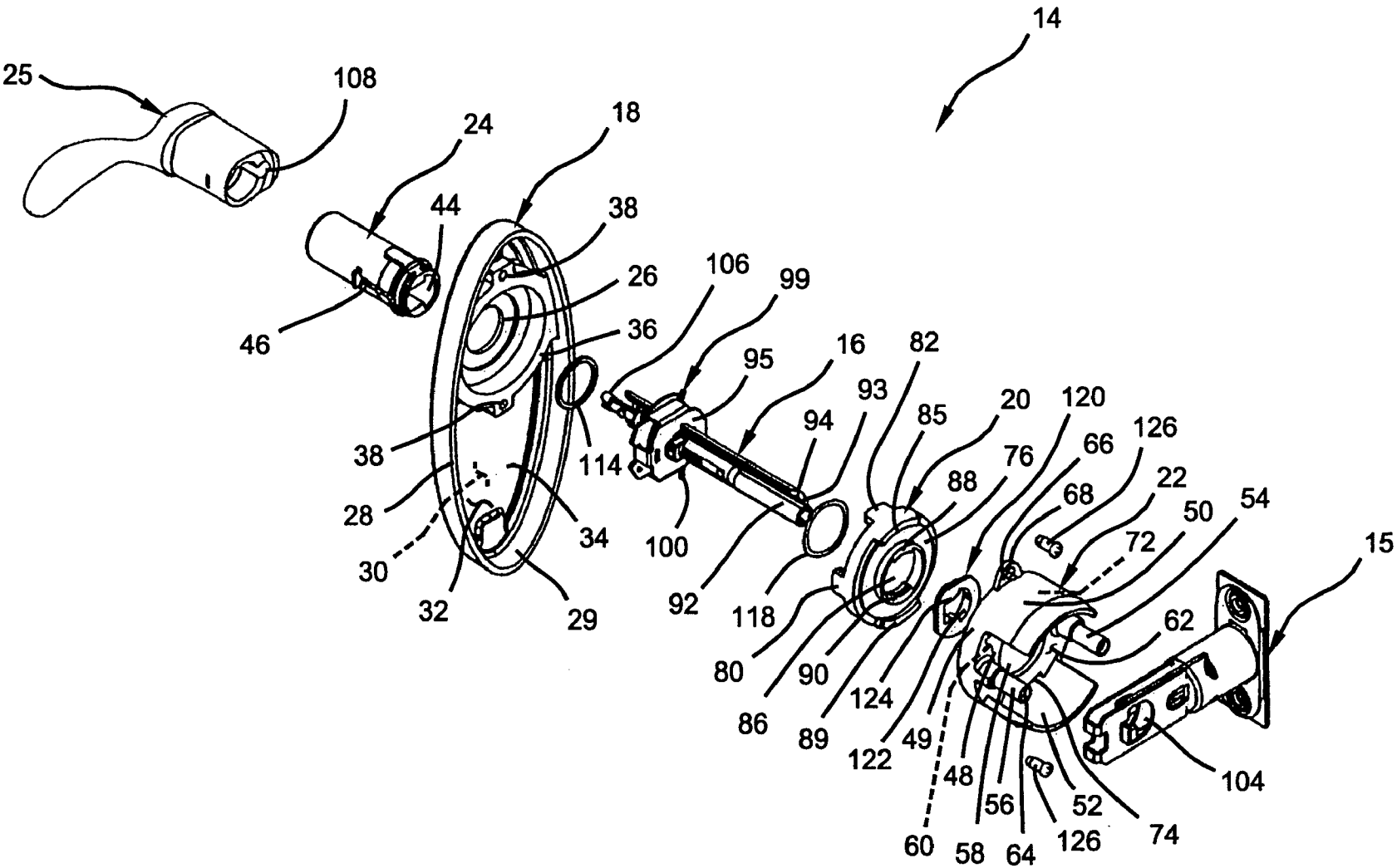
FIG. 2 is an exploded view of an interior mechanism of the lockset of FIG. 1.

The exterior mechanism 14 includes an escutcheon 18, a housing 20, a retainer shield 22, and a sleeve 24, whereby the escutcheon 18 fixedly supports the retainer shield 22 and rotatably supports the housing 20 and sleeve 24. The escutcheon 18 includes an aperture 26, a flange 28, an exterior surface 30, and interior surface 32. The flange 28 extends axially around an outer perimeter of the escutcheon 18, and extends generally away from the interior surface 32, as best shown in FIG. 2.

The interior surface 32 and flange 28 cooperate to form a pocket 34 extending generally across the interior surface 32 between the interior surface of the flange 28. The pocket 34 includes a cylindrical rib 36 disposed therein, whereby the cylindrical rib 36 is coaxially aligned with the aperture 26 and extends generally from the interior surface 32. The rib 36 is integrally formed with the escutcheon 18 and extends generally between two portions of the flange 28, as best shown in FIG. 2. In addition, the rib 36 includes a pair of attachment apertures 38.

The sleeve 24 is a generally elongate cylindrical member having a bore 44 formed therethrough and includes a catch 46 projecting therefrom to releasably couple the first sleeve 24 to a handle assembly 25. The bore 44 is operable to fixedly attach the sleeve 24 to the spindle assembly 16, as will be discussed further below.

The retainer shield 22 is fixedly supported by the escutcheon 18 and includes a cylindrical main body 48, a first and second flange 50, 52, and a first and second post 54, 56. The main body 48 includes a central aperture 58 formed therethrough, an exterior surface 60, and an interior surface 62. The first and second flanges 50, 52 extend from the interior surface 62 of the main body 48 and have a generally arcuate shape. In addition, the first flange 50 is diametrically opposed to the second flange 52 such that the first and second flanges 50, 52 are formed on opposite sides of the central aperture 58.

The first and second posts 54, 56 are also formed integrally with the main body 48 and extend generally from the interior surface 62. The first and second posts 54, 56 each include a tapped bore 64 at a distal end for interaction with the interior mechanism 12, as will be discussed further below. In addition, the first post 54 is diametrically opposed to the second post 56 such that the first and second posts 54, 56 are formed on opposite sides of the central aperture 58.

The retainer shield 22 further includes a pair of ears 66 having attachment apertures 68 formed therethrough. The ears 66 are formed proximate the base of both the first and second flanges 50, 52 and extend therefrom generally perpendicular to a side wall 49 of the main body 48. In addition, the retainer shield 22 includes a pair of slots 72, 74 formed at the base of the first and second flange 50, 52, respectively. The slots 72, 74 are formed through the main body 48 and extend from the exterior surface 60 to the interior surface 62.

The housing 20 is rotatably supported by the spindle assembly 16 and is disposed between the retainer shield 22 and the escutcheon 18. The housing 20 includes a main body 76, a first and second post 78, 80, and a first and second stop 82, 84. The main body 76 is a generally cylindrical member having a central aperture 86 formed therethrough. In addition, the main body 76 includes a first and second tab 88, 90 extending into the central aperture 86, whereby the first tab 88 is diametrically opposed to the second tab 90, as best shown in FIG. 2. The first and second posts 78, 80 are formed integral with the main body 76 and are positioned such that the first post 78 is diametrically opposed to the second post 80. Similarly, the first and second stops 82, 84 are integrally formed with the main body 76 and are also diametrically opposed to one another. In this manner, the first and second posts 78, 80, and first and second stops 82, 84, are equally spaced around the perimeter of the main body 76.

The housing 20 further includes first and second locking tabs 85, 87 extending from the housing 20, and formed generally at the base of the first and second stops 82, 84. Specifically, the first and second tabs 85, 87 extend from the housing 20 in a direction generally opposite to that of the first and second stops 82, 84 such that the first and second locking tabs 85, 87 oppose the first surface 60 of the retainer shield 22.

The spindle assembly 16 includes a full-round spindle 92 and a half-round spindle 94, whereby the full round spindle 92 and half-round spindle are operable to couple a handle assembly 25 with the latch bolt assembly 15 via sleeve 24. Full-round spindle 92 and half-round spindle 94 are generally elongate cylindrical members and are rotatably supported by a housing 95. The spindle assembly 16 further includes a torsion spring mechanism 99 disposed within the housing 95. The torsion spring mechanism 99 includes a torsion spring 100 operably coupled between the half-round spindle 94 and the escutcheon 18 to provide a biased return torque for maintaining the latch bolt assembly 15 in an extended position. The torsion spring mechanism 99 further includes a locking slide 102 operably coupled to the full-round spindle 92 and slidably positionable upon rotation of the full-round spindle 92 between a locked condition and an unlocked condition. The slide 102 engages the housing 95 in the locked condition to restrict rotation of the spindle assembly 16 and disengages the housing 95 in the unlocked condition to permit rotation of the spindle assembly 16. Full-round spindle 92 and half-round spindle 94 are received in an aperture 104 formed in latch bolt assembly 15, whereby the aperture 104 includes a generally arcuate surface 105 for mating engagement with an arcuate surface 93 of the half-round spindle 94. Half-round spindle 94 is operably coupled to the latch bolt 15 such that rotation of handle assembly 25 actuates latch bolt assembly 15 for movement between an extended position and a retracted position.

The exterior end 106 of full-round spindle 92 is operably coupled to a lock cylinder 108 such that rotation of a keyed member (not shown) in the lock cylinder 108 rotates the full-round spindle 92 causing the slide 102 to move between the locked and unlocked positions. The end of full-round spindle 92, generally opposite the exterior end 106, may be adapted to receive a turn button assembly 110 operably associated with an interior knob or lever assembly 112 for manipulating the slide 102 between the locked and unlocked state, as will be discussed further below with respect to the interior mechanism 12.

Figure 3:
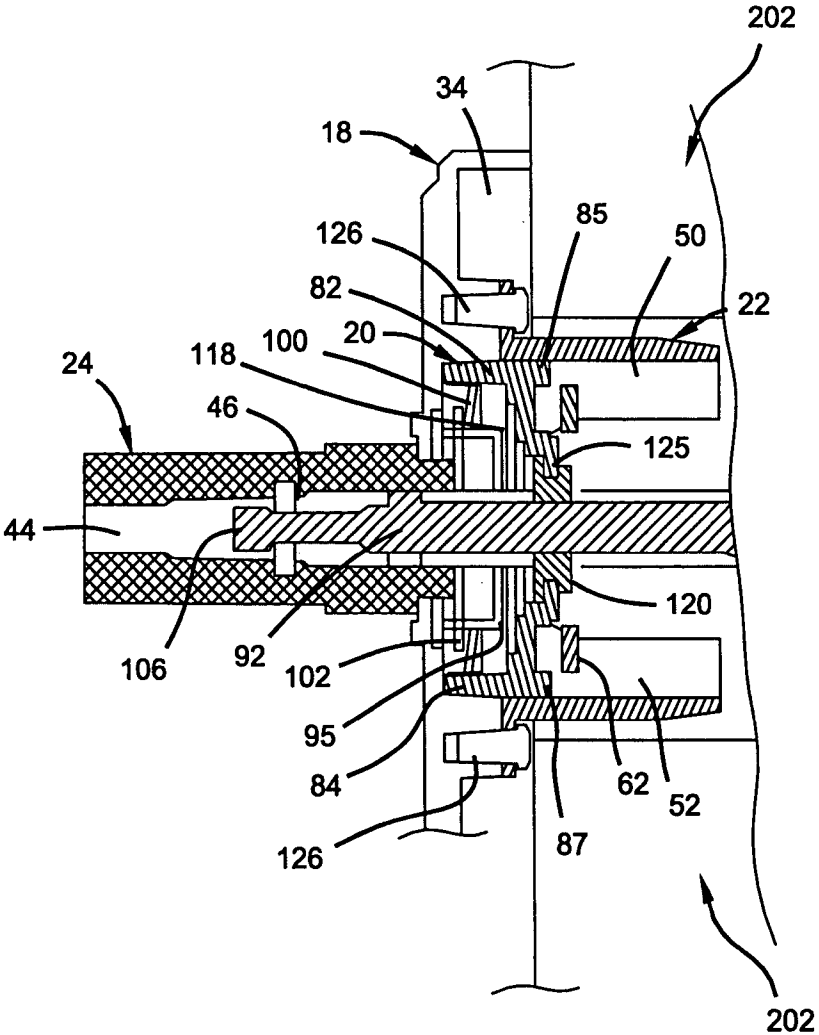
FIG. 3 is a cross-sectional view of the lockset of FIG. 2 in accordance with the principals of the present invention in an unlocked position.

The sleeve 24 is rotatably attached to the escutcheon 18 and is fixedly attached to the spindle assembly 16 for rotation therewith. Specifically, the housing 95 is fixedly attached to the sleeve 24 generally at the opening of aperture 44 such that the full and half round spindles 92, 94 are rotatably received through the aperture 44 of the sleeve 24. In this addition, the spindle assembly 16 is rotatably supported at the second surface 32 of the escutcheon 18 by a snap washer 114 having the housing 95 disposed adjacent the second surface 32 of the escutcheon 18, as best shown in FIG. 3.

Figure 4:
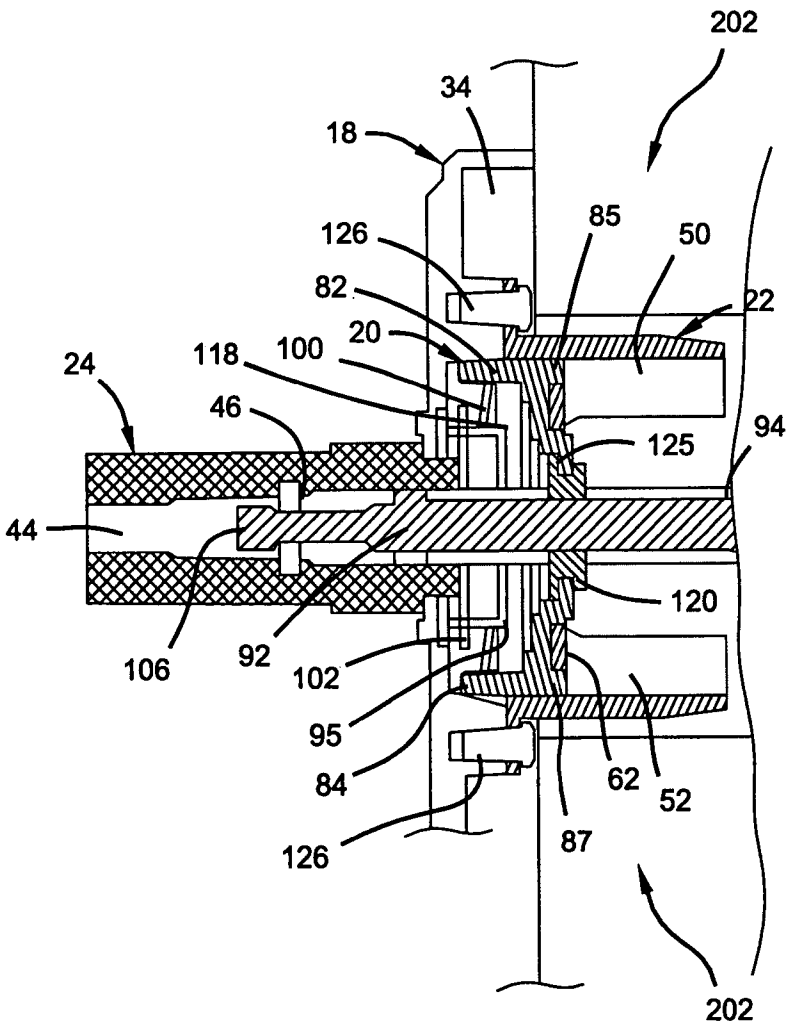
FIG. 4 is a cross-sectional view of the lockset of FIG. 3 in a locked position.

The half-round spindle 94 supports the housing 20 and is fixed for rotation therewith. Specifically, the half-round spindle 94 receives the central aperture 86 of the main body 76 and includes a compression spring 118 disposed therebetween. As best shown in FIGS. 3 and 4, the assembly of the housing 20 to the half-round spindle 94 aligns the housing 20 such that the first and second posts 78, 80 and first and second stops 82, 84 are positioned to selectively engage the torsion spring 100. To position the half-round spindle 94 in relation to the housing 20, a bearing 120 is provided. The bearing 120 is a generally flat member having an arcuate surface 122 formed theretrough for mating engagement with the generally arcuate surface 93 of the half-round spindle 94. In this manner, the mating engagement between the arcuate surface of the bearing 120 and the arcuate surface 93 of the half-round spindle 94 inhibits misalignment therebetween.

The bearing 120 further includes a projection 124 having an engagement surface 125, whereby the projection 124 is positioned to selectively engage the first and second tabs 88, 90 of the housing 20. In this manner, as a rotational force is applied to the bearing 120, sufficient rotation thereof will cause the engagement surface 125 of the projection 124 to engage the first and second tabs 88, 90 and cause the housing 20 and spindle assembly 16 to rotate relative the escutcheon 18.

To secure the housing 20, spindle assembly 16, and compression spring 118 to the escutcheon 18, the retainer shield 22 is positioned relative to the escutcheon 18 such that the attachment apertures 68 of the ears 66 are aligned with the attachment apertures 38 of the escutcheon 18. Once properly aligned, a pair of fasteners 126 are driven through attachment apertures 68 and 38 to secure the retainer shield 22 to first escutcheon 18. In this manner, the housing 20 is coupled to the retainer shield 22 by the first and second locking tabs 85, 87 seated in the first and second slots 72, 74 of the retainer shield 22 and held in engagement therewith by a force imparted by the compression spring 118. In this regard, the housing 20, sleeve 24, and spindle assembly 16 are not rotatable relative the escutcheon 18 because the housing 20 is fixed to the retainer shield 22, as best shown in FIG. 4.

To rotate the housing 20, sleeve 24, and spindle assembly 16 relative the escutcheon 18, a force is applied to the bearing 120 against the bias of the compression spring 118. Sufficient compression of the spring 118 will disengage the first locking tab 85 from the first slot 72 and the second locking tab 87 from the second slot 74. Once disengaged, as shown in FIG. 3, rotation of the bearing 120 will cause the engagement surface 125 of the projection 124 to engage the first and second tabs 88, 90, thereby rotating the housing 20 as the bearing 120 rotates. Rotation of the bearing 120, once engaged with the housing 20, will cause the housing 20, sleeve 24, and spindle assembly 16 to rotate 180° until the first locking tab 85 is seated in the second slot 74 and the second locking tab 87 is seated in the first slot 72. Once properly aligned with the slots 72, 74 the compressive force applied to the bearing 120 may be released, thereby locking the housing 20 to the retainer shield 22 once again. It should be understood that by rotating the spindle assembly 16 180°, the orientation of the half-round spindle 94 may be reconfigured relative to the escutcheon 18.

The interior mechanism 12 includes an escutcheon 18*a*, a housing 20*a*, a retainer shield 22*a*, and a sleeve 24*a*, whereby the escutcheon 18*a* rotatably supports the housing 20*a* and fixedly supports the retainer shield 22*a* and sleeve 24*a*. In view of the substantial similarity in structure and function of the components associated with the exterior mechanism 14 with respect to the interior mechanism 12, like reference numerals are used hereinafter and in the drawings to identify like components while like reference numerals containing letter extensions are used to identify those components that have been modified.

The escutcheon 18*a* is identical to the first escutcheon 18 except for a pair of attachment apertures 128 disposed on either side of aperture 26. In this regard, further details of the escutcheon 18*a* are unnecessary. The sleeve 24*a* is a generally elongate cylindrical member having a bore 44*a* formed therethrough and includes the turn button assembly 110 operably disposed therein. The sleeve 24*a* is rotatably received by the attachment aperture 26 of the escutcheon 18*a* and is attached thereto by a retaining ring 132.

The turn button assembly 110 includes a button 134 disposed on an exterior portion of the second sleeve 24*a* and a post 136 disposed within the bore 44*a*. The button 134 is operable to engage and disengage the slide 102 as previously discussed while the post 136 receives a slot 138 formed in the full-round spindle 92 for communication with the spindle assembly 16. Specifically, the mating engagement between the full-round spindle 92 and post 136 allows the rotation of the button 134 to engage and disengage the slide 102 with the housing 95, thereby locking and unlocking the lockset 10.

The housing 20*a* is identical to housing 20 except that housing 20*a* does not include the first and second tabs 88, 90. In this regard, further details of housing 20*a* are unnecessary. It should be understood, however, that housing 20*a* is rotatably supported by sleeve 24*a*, as best shown in FIG. 3, whereby the central aperture 86 includes an axial wall 89 and receives sleeve 24*a*.

A torsion spring 100*a* is disposed between the housing 20*a* and the escutcheon 18*a* such that the torsion spring 100*a* abuts the inner surface 32 of the escutcheon 18*a* generally at the cylindrical rib 36. In addition, a compression spring 118 is disposed between the housing 20*a* and the torsion spring 100*a*, as best shown in FIG. 2.

The retainer shield 22*a* includes a central portion 140 having an attachment aperture 142 and a flange 144 extending therefrom. The flange 144 axially surrounds the perimeter of the retainer shield 22*a* and includes a first and second slot 146, 148 formed generally at a junction of the flange 144 and the central portion 140. In addition, the flange 144 includes a pair of ears 150 extending therefrom having a pair of attachment apertures 152 formed therethrough.

The retainer shield 22*a* is fixedly attached to the second escutcheon 18*a* to maintain the rotatable attachment of the housing 20*a* and the torsion spring 100*a* to the sleeve 24*a*. Specifically, a pair of fasteners 154 are inserted through the attachment apertures 152 of the ears 150 and through the attachment apertures 38 of the rib 36 to fixedly secure the retainer shield 22*a* to the escutcheon 18*a*. In this manner, the housing 20*a* is coupled to the retainer shield 22*a* by the first and second locking tabs 85, 87 seated in the first and second slots 146, 148 of the retainer shield 22*a* and held in engagement therewith by a force imparted thereon by the compression spring 118*a*. In this regard, the housing 20*a* and torsion spring 100*a* not rotatable relative the escutcheon 18*a* due to the housing 20*a* being fixed to the retainer shield 22*a*.

Figure 7:
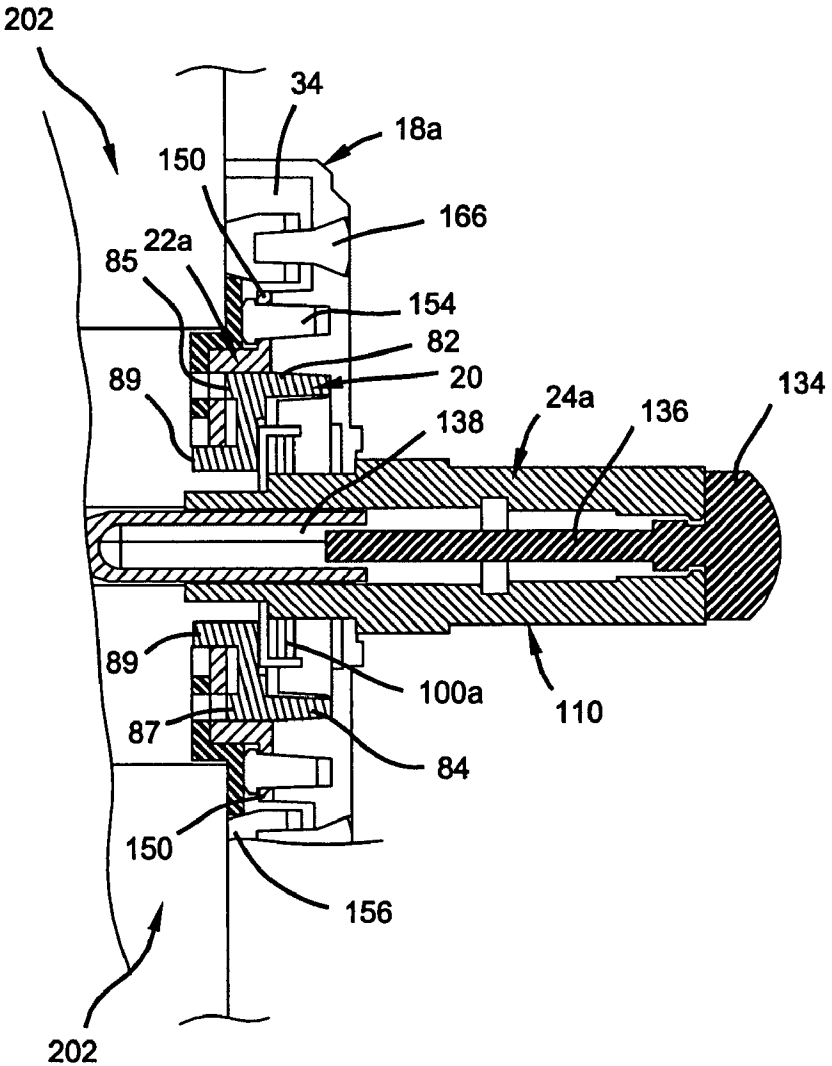
FIG. 7 is a cross-sectional view of the lockset of FIG. 3 in a locked position.
Figure 6:
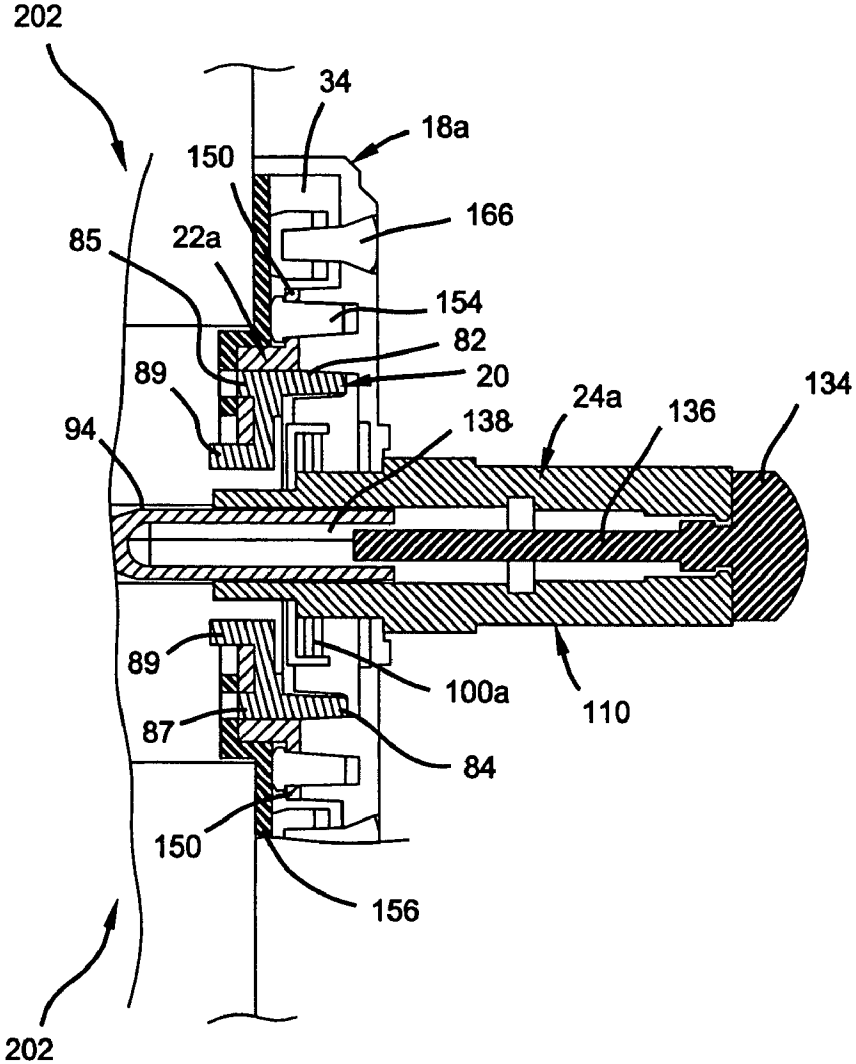
FIG. 6 is a cross-sectional view of a lockset in accordance with the principals of the present invention in an unlocked position.

To rotate the housing 20*a* and torsion spring 100*a* relative the escutcheon 18*a*, a force is applied to the housing 20*a* against the bias of the compression spring 118*a*. Sufficient compression of the spring 118*a* will disengage the first locking tab 85 from the first slot 146 and the second locking tab 87 from the second slot 148. Once disengaged, as shown in FIG. 6, rotation of the housing 20*a* is allowed. Rotation of the housing 20*a* will concurrently cause the torsion spring 100*a* to rotate due to the interaction between the torsion spring 100*a* and the first and second posts 78, 80. Sufficient rotation of the housing 20*a* will align the first locking tab 85 with the second slot 148 and the second locking tab 87 with the first slot 146. Once properly aligned with the slots 146, 148 the compressive force applied to the housing 20*a* may be released, thereby locking the housing 20*a* in a new orientation relative to the retainer shield 22*a*, as shown in FIG. 7.

Figure 8A:
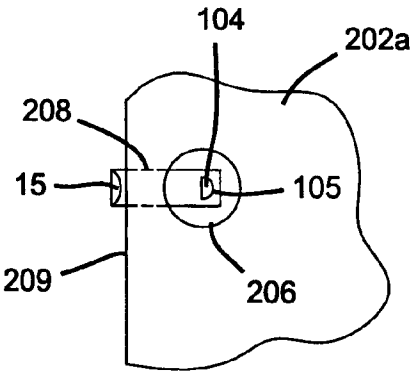
FIG. 8A is a cutaway section of a right-handed door having a latch mechanism disposed therein.
Figure 8B:
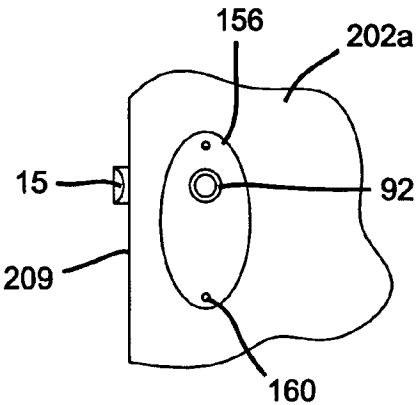
FIG. 8B is a cutaway section of the door of FIG. 8A having a lockset partially installed thereon.
Figure 8C:
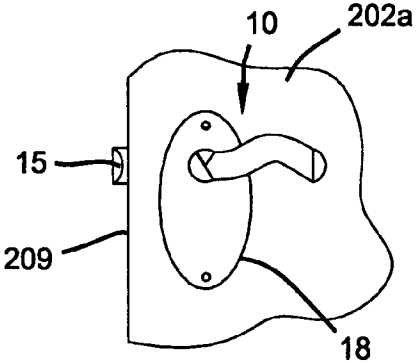
FIG. 8C is a cutaway section of the door of FIG. 8A having a lockset fully installed thereon.
Figure 9A:
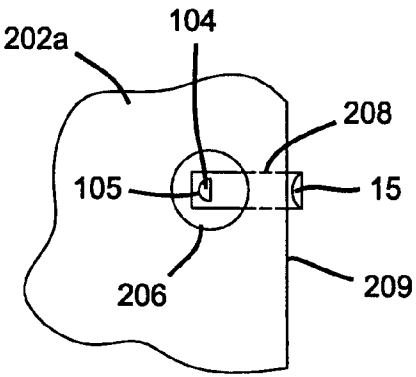
FIG. 9A is a cutaway section of a left-handed door having a latch mechanism disposed therein.

With particular reference to FIGS. 1, 8A–8C, and 9A–9C, the installation of the lockset 10 to a door assembly 200 will be described in detail. The door assembly 200 includes a door 202 and a door frame 204, whereby the door 202 is pivotably supported by the door frame 204. The door 202 includes a first bore 206 formed therethrough and a second bore 208 formed perpendicular to the first bore 206, whereby the second bore 208 intersects the first bore 206, as best shown in FIGS. 8A and 9A. The first and second bores 206, 208 are formed proximate to a first edge 209 of the door 202 generally opposite from a series of hinges 210. The hinges 210 are disposed on a second edge 211 of the door 202 and serve to pivot the door between an open and closed position relative to the door frame 204. It should be understood that a right-handed and a left-handed door are constructed in a similar fashion and that the position of the hinges 210 on either the first edge 209 or second edge 211 determines whether the door is considered a right or a left-handed door.

The door frame 204 includes a latch plate 212 fixedly attached thereto, whereby the latch plate 212 is a generally flat plate having an aperture (not shown) formed therethrough. The latch plate 212 is fixedly attached to the door frame 204 generally opposite from hinges 210 and is operable to engage the lockset 10 to secure the door 202 in the closed position. Specifically, the latch plate 212 cooperates with the lockset 10 to selectively lock the door 202 in the closed position. In this manner, the latch plate 212 must be properly positioned on the frame 204 such that the lockset 10 contacts the latch plate 212 when the door 202 is in the closed position.

Figure 9B:
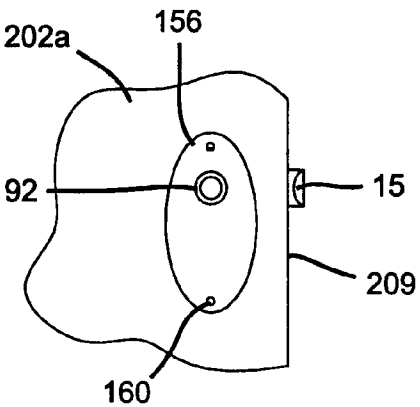
FIG. 9B is a cutaway section of the door of FIG. 9A having a lockset partially installed thereon.
Figure 9C:
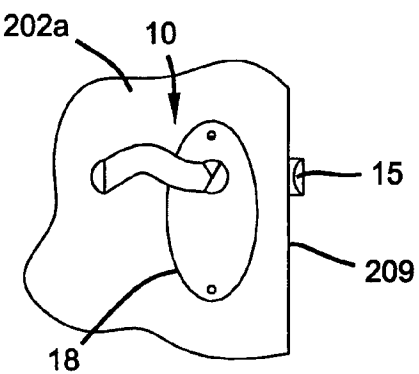
FIG. 9C is a cutaway section of the door of FIG. 9A having a lockset fully installed thereon.

As alluded to above, and as indicated in FIGS. 8B and 9B, the lockset 10 is operably supported by the door 202 at the first bore 206 while the latch bolt mechanism 15 is operably supported by the door 202 at the second bore 208. To install the lockset 10, an installer first determines the orientation of the door 202 relative the door frame 204. Specifically, the installer must determine if the door is a right-handed or a left-handed door by observing which edge of the door the hinges 210 are disposed and which way the door 202 opens. This determination is important in that the handing of the door 202 will determine the orientation of the latch bolt mechanism 15. The orientation of the latch bolt mechanism 15 will ultimately govern the installation of the lockset 10, as will be discussed further below.

A right-handed door 202*a* opens to the right such that the latch plate 212 is positioned to the left of the lockset 10 relative to the view shown in FIG. 8A. In this situation, the latch bolt mechanism 15 is inserted into the second bore 208 such that the arcuate surface 105 of aperture 104 faces away from the first edge 209 of the door 202, as best shown in FIG. 8A. To properly install the lockset 10 into the first bore 208, the half-round spindle 94 must be properly aligned with the latch bolt assembly 15 such that the arcuate surface 93 of the half-round spindle 94 is matingly received by the arcuate surface 105 of the latch bolt assembly 15.

Figure 5:
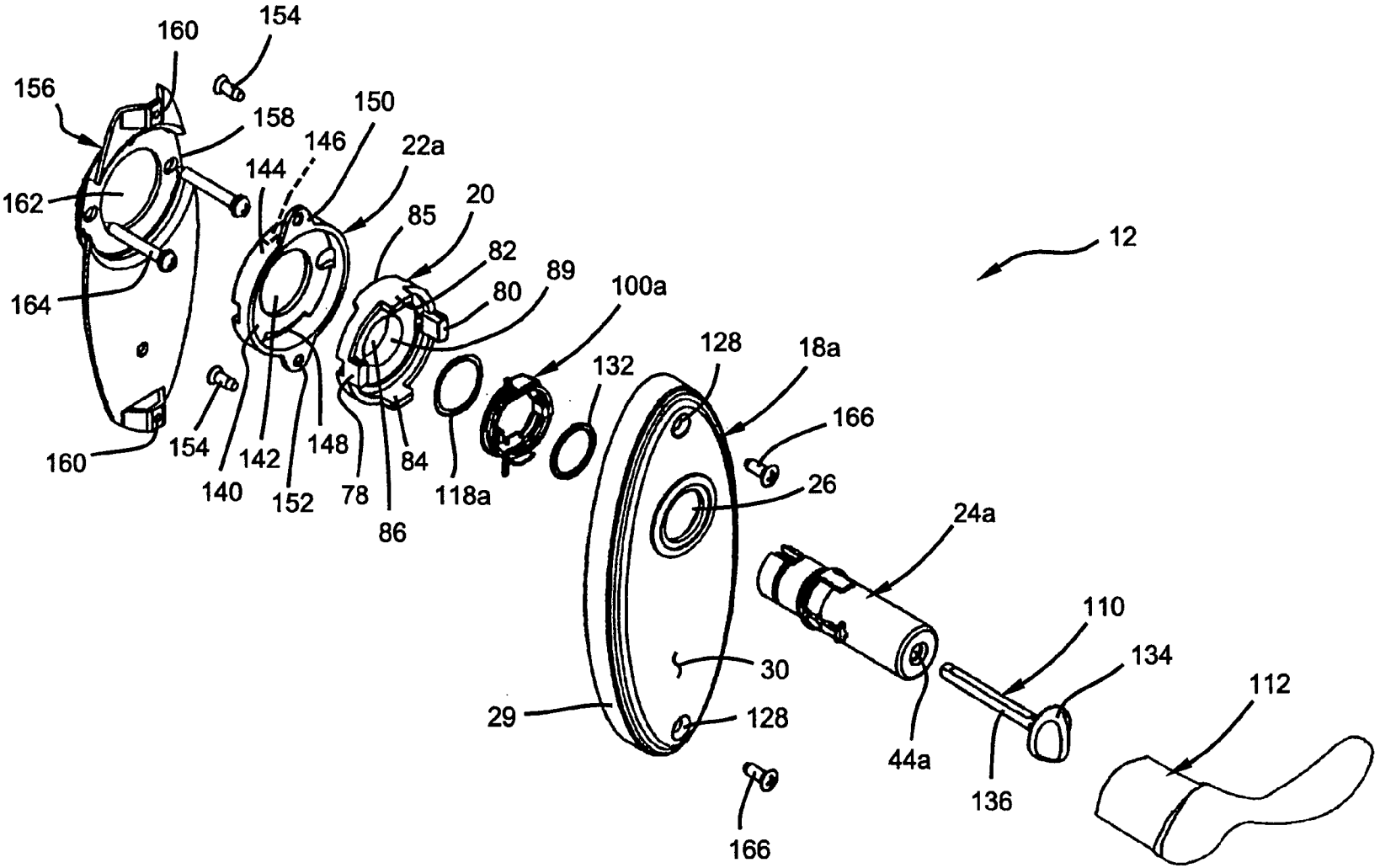
FIG. 5 is an exploded view of an exterior mechanism of the lockset of FIG. 1.

In one situation, the lockset 10 is properly aligned to accommodate a right-handed door 202*a*. In this case, the installer first aligns the arcuate surface 93 of the half-round spindle 94 with the arcuate surface 105 of the latch bolt assembly 15 and then inserts the half-round spindle 94 into the latch bolt assembly 15. To fixedly secure the exterior mechanism 14 to the door 202, a mounting plate 156 is provided and includes a pair of attachment apertures 158, a pair of threaded apertures 160, and a main aperture 162, as best shown in FIG. 5.

The mounting plate 156 is fixedly secured to the first retainer shield 22 by a pair of fasteners 164, whereby the fasteners 164 are first inserted through the attachment apertures 158 of the mounting plate 156 and then into the tapped bores 64 of the first and second posts 54, 56. In this manner, the full and half round spindles 92, 94 extend from the main aperture 162 of the mounting plate 156.

To install the interior mechanism 12, the sleeve 24*a* is aligned with the full-round spindle 92 to ensure that the slot 138 aligns with the post 136 of the turn button assembly 110. Again, to ensure that the interior mechanism 12 is properly setup for a right-handed door 202*a*, the installer must check to verify that the torsion spring 100*a* properly aligns with the housing 20*a*. Assuming the torsion spring 100*a* is properly set up for a right-handed door 202*a*, the interior mechanism 12 is aligned with the door 202*a* such that the sleeve 24*a* is inserted into the first bore 206 for attachment to the full-round spindle 92 of the exterior mechanism 14.

Once properly aligned, a pair of fasteners 166 are inserted through attachment apertures 128 of the escutcheon 18*a* to fixedly attach the interior mechanism 12 to the mounting plate 156. Specifically, the fasteners 166 are first inserted into apertures 128 of the escutcheon 18*a* and then into the threaded apertures 160 of the mounting plate 156. Upon securing the fasteners 166 into the threaded apertures 160, the lockset 10 is fixedly installed on the door assembly 200.

In the situation that the door assembly 200 includes a left-handed door 202*b* and the lockset 10 is setup to accommodate a right-handed door 202*a*, the arcuate surface 93 of the half-round spindle 94 will not be properly aligned with the arcuate surface 105 of the latch bolt assembly 15, due to the orientation of the latch bolt assembly 15 to the left-handed door 202. More particularly, the arcuate surface 93 of the half-round spindle 94 will be 180° out of alignment with the latch bolt assembly 15. To properly align the spindle assembly 16 with the latch bolt assembly 15, a force must be applied to the bearing 120 to rotate the housing 20, spindle assembly 16, and sleeve 24, as previously discussed. Once the housing 20, spindle assembly 16, and sleeve 24 have been rotated 180°, the exterior mechanism 14 can be installed on the left-handed door 202*b* by fixedly attaching the exterior mechanism to the mounting plate 156, as previously discussed.

To properly align the interior mechanism 12, a force is applied to housing 20*a*, whereby the force allows the installer to rotate the housing 20*a* and torsion spring 100*a* 180° relative the escutcheon 18*a*. Once rotated and properly aligned, the interior mechanism 12 may be fixedly attached to the mounting plate 156, as previously described. In this regard, the lockset 10 is capable of accommodating either a right-handed or a left-handed door 202*a*, 202*b*.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of installing a lockset on a handed door, the method comprising the steps of:

applying a force to a bearing mounted on an external mechanism of the lockset against a biasing force of a first biasing member;

rotating said bearing into engagement with a first housing fixedly supported by a spindle assembly of the lockset;

rotating said bearing and said first housing until said spindle assembly is properly aligned with a latch of the handed door;

releasing said force on said bearing to allow said first biasing member to bias said first housing into engagement with a first retainer shield to lock said spindle assembly and said first housing relative a first escutcheon;

applying a force to a second housing mounted on an interior mechanism of the lockset against a biasing force of a second biasing member;

rotating said second housing to rotatably position said interior mechanism relative said exterior mechanism and the handed door; and releasing said force on said second housing to allow said second biasing member to bias said second housing into engagement with a second retainer shield to lock said second housing relative a second escutcheon.

2. The method of installing a lockset on a handed door of claim 1 wherein said first housing includes a first pair of posts, said first posts operable to selectively engage a first pair of slots formed in said first retainer shield to selectively lock said first housing relative said first retainer shield.

3. The method of installing a lockset on a handed door of claim 2, wherein said first set of posts are diametrically opposed and said first pair of slots are diametrically opposed to provide said spindle assembly with 180° of rotational adjustment relative said first escutcheon.

4. The method of installing a lockset on a handed door of claim 1, wherein said second housing includes a second pair of posts, said second pair of posts operable to selectively engage a second pair of slots formed in said second retainer shield to selectively lock said second housing relative said second retainer shield.

5. The method of installing a lockset on a handed door of claim 4, wherein said second set of posts are diametrically opposed and said second pair of slots are diametrically opposed to provide said spindle assembly with 180° of rotational adjustment relative said second escutcheon.

6. The method of installing a lockset on a handed door of claim 1, wherein said first biasing member is a spring.

7. The method of installing lockset on a handed door of claim 1, wherein said second biasing member is a spring.

* * * * *